US009728364B2

(12) United States Patent
Onoda

(10) Patent No.: US 9,728,364 B2
(45) Date of Patent: Aug. 8, 2017

(54) FUSIBLE LINK

(71) Applicant: Yazaki Corporation, Tokyo (JP)

(72) Inventor: Shinya Onoda, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 14/966,113

(22) Filed: Dec. 11, 2015

(65) Prior Publication Data

US 2016/0172142 A1 Jun. 16, 2016

(30) Foreign Application Priority Data

Dec. 12, 2014 (JP) ..... 2014-251719

(51) Int. Cl.
*H01H 85/00* (2006.01)
*H01H 85/055* (2006.01)
(Continued)

(52) U.S. Cl.
CPC ..... *H01H 85/055* (2013.01); *H01H 85/044* (2013.01); *H01H 85/20* (2013.01);
(Continued)

(58) Field of Classification Search
CPC .... H01H 85/055; H01H 85/20; H01H 85/044; H01H 2231/026; H01H 2085/0555; H01H 2085/025; H02H 7/18
(Continued)

(56) References Cited

U.S. PATENT DOCUMENTS 2,454,487 A * 11/1948 Storck, Jr. ..... H01H 85/0241 24/511
6,294,978 B1 * 9/2001 Endo ..... H01H 85/044 337/159
(Continued)

FOREIGN PATENT DOCUMENTS

JP 2011-222189 A 11/2011
JP 2014-022303 A 2/2014
(Continued)

OTHER PUBLICATIONS

Communication dated Nov. 24, 2016, issued by the Korean Intellectual Property Office in corresponding Korean Application No. 10-2015-0175669.
(Continued)

*Primary Examiner* — Anatoly Vortman
(74) *Attorney, Agent, or Firm* — Sughrue Mion, PLLC

(57) ABSTRACT

A fusible link includes a power supply portion provided on a connection terminal that connects to a battery terminal, a circuit terminal that connects to a circuit, a power-supply side upstanding portion standing in an out-of-plane direction of a terminal mounting surface from an edge substantially parallel to an extending direction of the battery terminal out of an outer circumferential edge near the power supply portion of the connection terminal, a circuit-side upstanding portion standing in the same direction as the power-supply side upstanding portion from an edge substantially parallel to the extending direction out of an outer circumferential edge of the circuit terminal, and a bridge portion extending between the power-supply side upstanding portion and the circuit-side upstanding portion. The power-supply side upstanding portion, the circuit-side upstanding portion, and the bridge portion function as a fuse element that fuses when a current greater than a threshold value flows.

6 Claims, 5 Drawing Sheets

(51) Int. Cl.
*H01H 85/044* (2006.01)
*H01H 85/20* (2006.01)
*H01H 85/02* (2006.01)

(52) U.S. Cl.
CPC ..... *H01H 2085/025* (2013.01); *H01H 2085/0555* (2013.01); *H01H 2231/026* (2013.01)

(58) Field of Classification Search
USPC ..... 337/295, 142
See application file for complete search history.

(56) References Cited

U.S. PATENT DOCUMENTS 6,806,421 B2 * 10/2004 Matsumura ..... H01H 85/044 174/50
9,384,929 B2 * 7/2016 Masuda ..... H01H 85/0241
9,490,090 B2 * 11/2016 Nohara ..... H01H 85/205
2013/0027174 A1 * 1/2013 Masuda ..... H01H 85/0241 337/142
2015/0130584 A1 5/2015 Totsuka et al.
2015/0357623 A1 12/2015 Onoda

FOREIGN PATENT DOCUMENTS

JP 2014-164889 A 9/2014
KR 20130001259 A 1/2013
WO 2011/126138 A1 10/2011

OTHER PUBLICATIONS

Communication dated Nov. 24, 2016, issued by the Korean Intellectual Property Office in corresponding Korean Application No. 10-2015-0175664.
Communication dated May 22, 2017, issued by the Korean Intellectual Property Office in corresponding Korean Application No. 10-2015-0175669.

* cited by examiner

FUSIBLE LINK

CROSS-REFERENCE TO RELATED APPLICATION(S)

The present application claims priority to and incorporates by reference the entire contents of Japanese Patent Application No. 2014-251719 filed in Japan on Dec. 12, 2014.

BACKGROUND OF THE INVENTION

1. Field of the Invention

The present invention relates to a fusible link for preventing a current greater than a specified value from flowing into a circuit for a vehicle, for example.

2. Description of the Related Art

Conventionally, the power supply to a circuit in a vehicle from a battery is often conducted via a fusible link in order to prevent a current greater than a specified value from flowing into the circuit (see Japanese Patent Application Laid-open No. 2011-222189, for example).

In FIG. 4, one example of a fuse unit including a conventional fusible link is illustrated in three orthographic views. This fuse unit 7 illustrated in FIG. 4 is the one that is directly mounted on a rod-shaped electrode 82 projecting from a terminal mounting surface 81 of a battery 8, and includes a battery terminal 71 and a fusible link 72.

The battery terminal 71 is a terminal having a substantially rectangular shape in planar view, and on one end side in the longitudinal direction thereof, an electrode insertion hole 711 into which the rod-shaped electrode 82 of the battery 8 is inserted is provided. On the other end side in the longitudinal direction, a screw 712 to couple the battery terminal 71 and the fusible link 72 together is provided. The battery terminal 71 is connected to the rod-shaped electrode 82 of the battery 8 near the one end, and extends toward the other end toward an outer edge 81*a* of the terminal mounting surface 81.

The fusible link 72 is formed with a power supply portion 721, two circuit terminals 722, and fuse elements 723 provided on a connection terminal 73 and housed inside a resin housing 724 composed of insulating resin material. In FIG. 5, illustrated is a structure object including the power supply portion, the two circuit terminals, and the fuse elements provided on the connection terminal in the fusible link illustrated in FIG. 4.

To the connection terminal 73, the battery terminal 71 is connected. On this connection terminal 73, provided is an insertion hole 73*a* into which the screw 712 of the battery terminal 71 is inserted. The screw 712 inserted into this insertion hole 73*a* is fastened with a nut 713, and thereby the battery terminal 71 is connected to the connection terminal 73.

The power supply portion 721 is provided on the connection terminal 73 in an integrated manner, and is supplied with the electrical power via the battery terminal 71 and the connection terminal 73.

On each of the two circuit terminals 722, a circuit that operates by the electrical power from the battery 8 is connected. On each circuit terminal 722, provided is a connection screw 722*a* to connect a round terminal and the like of an electrical wire constituting the circuit, for example. On the circuit terminal 722, formed is an insertion hole 722*b* into which this connection screw 722*a* is inserted. The circuit terminal 722 is housed inside the resin housing 724 in a state that the connection screw 722*a* is being inserted into the insertion hole 722*b*.

The fuse element 723 is formed connecting the power supply portion 721 and each of the two circuit terminals 722 in a belt-like shape narrower in width than the power supply portion 721 and the circuit terminal 722. Into each of the circuit terminals 722, the current from the battery 8 flows from the power supply portion 721 via the fuse element 723. When a current equal to or greater than a threshold value flows, the fuse element 723 fuses, and thereby an excessive current is prevented from flowing into the circuit.

The fusible link 72, as in the foregoing, is formed with the power supply portion 721, the two circuit terminals 722, and the fuse elements 723 formed of conductive metal and provided on the connection terminal 73 and housed inside the resin housing 724 composed of insulating resin material. The resin housing 724 is formed by insert molding in which the power supply portion 721, the two circuit terminals 722, and the fuse elements 723 provided on the connection terminal 73 are covered with and fixed (being molded) by the insulating resin material, for example. The resin housing 724 including insulating resin material covers and fixes parts of the circuit terminals 722, the fuse elements 723, and the power supply portion 721 provided on the connection terminal 73, in a state that the respective connection surfaces of the connection terminal 73 and the circuit terminals 722 are exposed and windows 724*a* are provided such that the fusing of the fuse elements 723 is visible. On the window 724*a* for visible recognition of fusing, a transparent cover 725 is put on, and the fusing of the fuse element 723 is visible through this transparent cover 725.

In recent years, space-saving in vehicles has been progressed and spatial allowance in the periphery of a battery installed has been dwindling, and thus downsizing of a fusible link that tends to occupy the space near the rod-shaped electrode of the battery has been required.

SUMMARY OF THE INVENTION

Consequently, being focused on the foregoing problem, an object of the present invention is to provide a downsized fusible link.

In order to achieve the above mentioned object, according to one aspect of the present invention, a fusible link includes a power supply portion provided on other end side of a battery terminal that is formed of conductive metal, connected at and near one end of the battery terminal to a rod-shaped electrode projecting from a terminal mounting surface of a battery, and extending toward an outer edge of the terminal mounting surface toward the other end of the battery terminal, or provided on a connection terminal that is formed of conductive metal in a plate shape, disposed substantially in parallel with the terminal mounting surface, and connected to the other end side of the battery terminal; a circuit terminal that is formed of conductive metal in a plate shape and is disposed substantially in parallel with the terminal mounting surface, and is connected to a circuit that is operated by electrical power from the battery; a power-supply side upstanding portion that is formed of conductive metal and stands in an out-of-plane direction of the terminal mounting surface from an edge substantially in parallel with the extending direction of the battery terminal out of an outer circumferential edge near the power supply portion of the battery terminal or out of an outer circumferential edge near the power supply portion of the connection terminal; a circuit-side upstanding portion that is formed of conductive metal and stands in the same direction as the power-supply side upstanding portion from an edge substantially in parallel with the extending direction out of an outer circumferential edge of the circuit terminal; and a bridge portion that is formed of conductive metal and extends between the power-supply side upstanding portion and the circuit-side upstanding portion, wherein at least one of the power-supply side upstanding portion, the circuit-side upstanding portion, and the bridge portion functions as a fuse element that fuses when a current equal to or greater than a threshold value flows.

According to another aspect of the present invention, in the fusible link, the power-supply side upstanding portion may be one that is formed extending in a belt-like form from an edge substantially in parallel with the extending direction of the connection terminal and being bent up in the out-of-plane direction, and the circuit-side upstanding portion may be one that is formed extending in a belt-like form from an edge substantially in parallel with the extending direction of the circuit terminal and being bent up in the out-of-plane direction.

The above and other objects, features, advantages and technical and industrial significance of this invention will be better understood by reading the following detailed description of presently preferred embodiments of the present invention, when considered in connection with the accompanying drawings.

DETAILED DESCRIPTION OF THE PREFERRED EMBODIMENT

Figure 1:
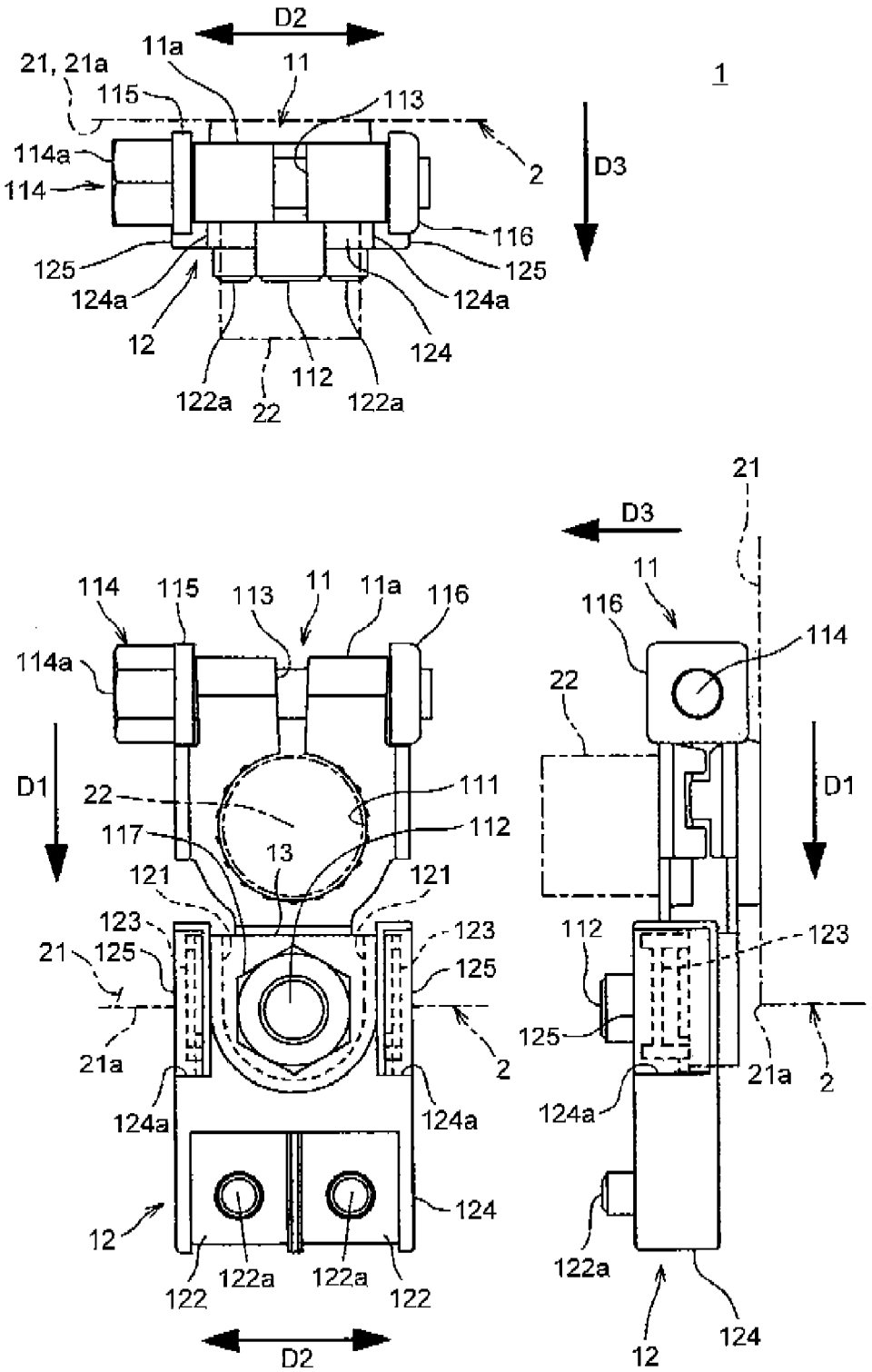
FIG. 1 is three orthographic views illustrating a fuse unit including a fusible link according to an embodiment of the present invention.
Figure 2:
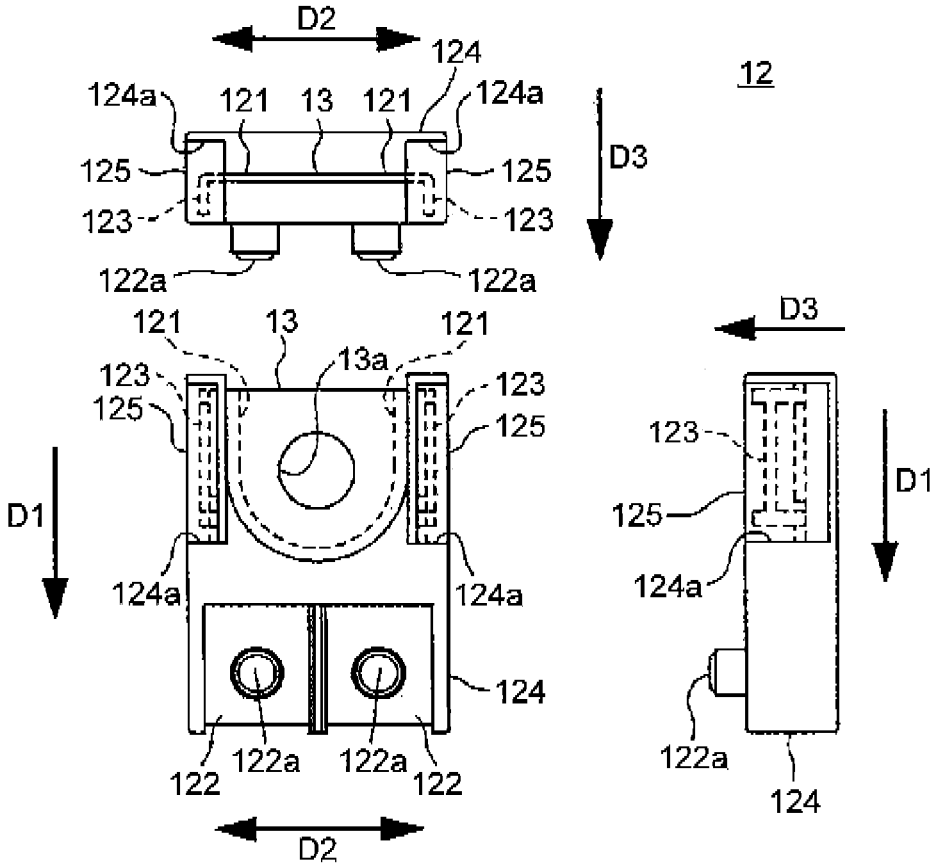
FIG. 2 is three orthographic views illustrating the fusible link illustrated in FIG. 1.
Figure 3:
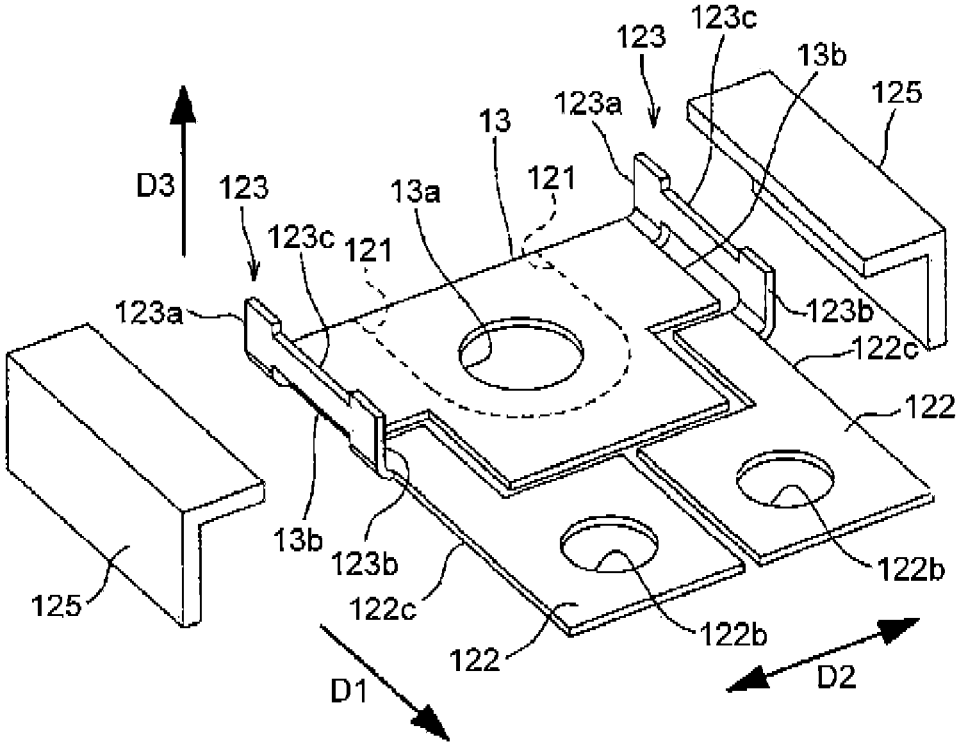
FIG. 3 is a perspective view illustrating a structure object including a power supply portion, two circuit terminals, and fuse elements provided on a connection terminal in the fusible link illustrated in FIGS. 1 and 2.
Figure 4:
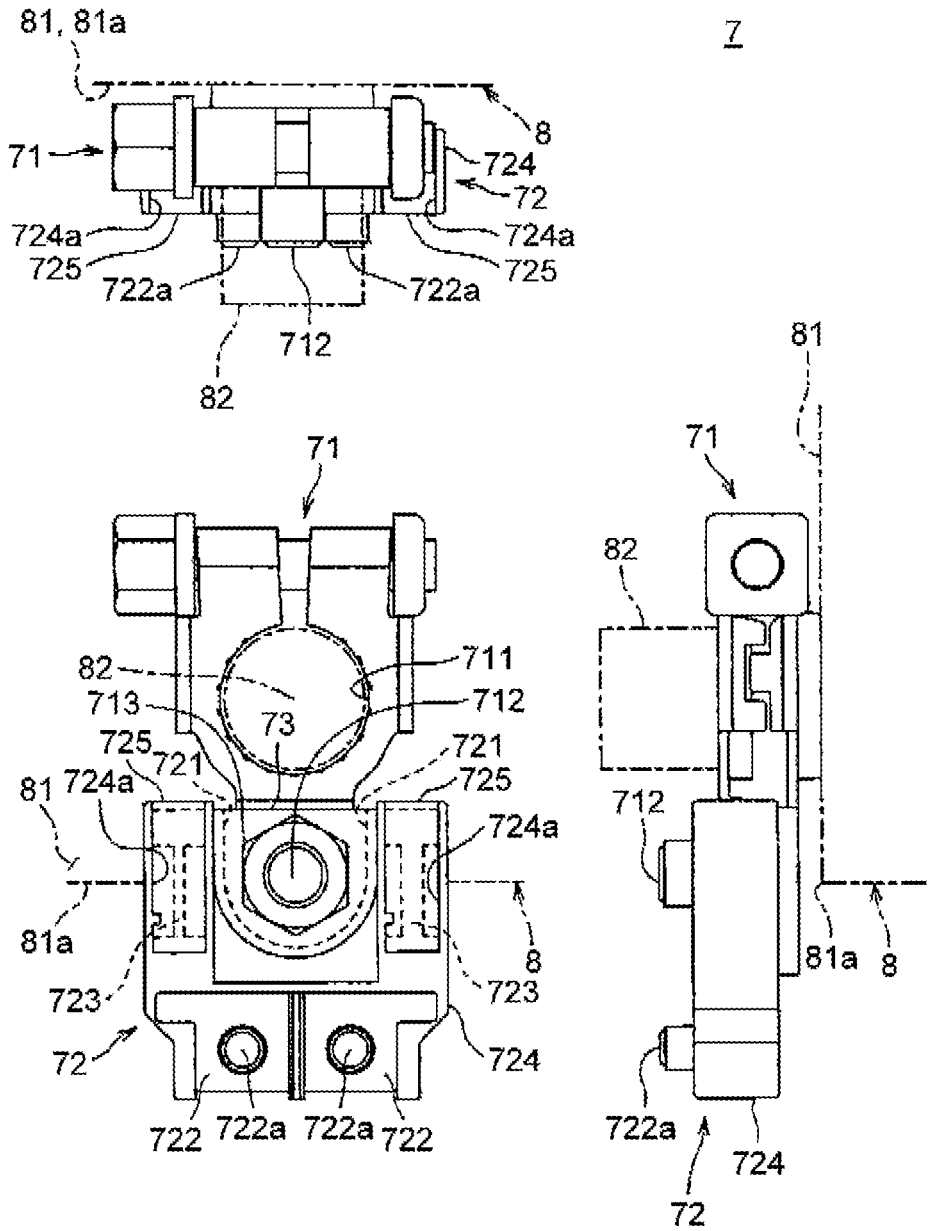
FIG.4 (Prior Art)
FIG. 4 is three orthographic views illustrating one example of a fuse unit including a conventional fusible unit.
Figure 5:
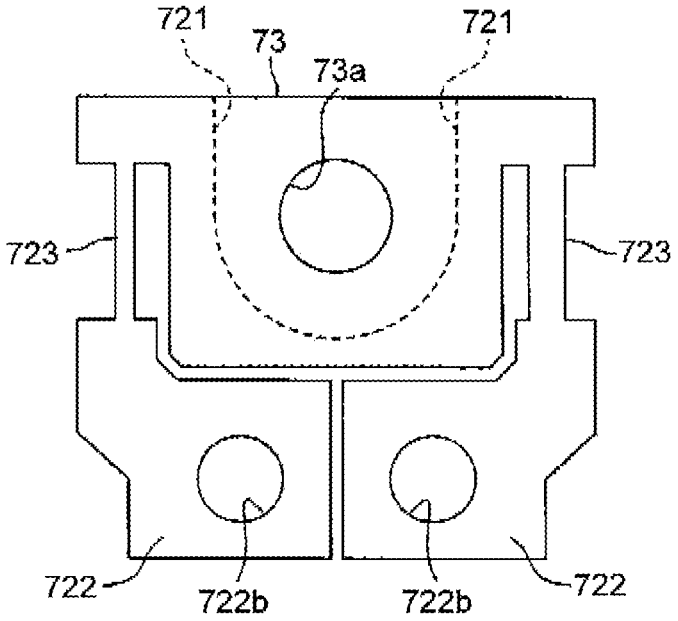
FIG.5 (Prior Art)
FIG. 5 is a planar view illustrating a structure object including a power supply portion, two circuit terminals, and fuse elements provided on a connection terminal in the fusible link illustrated in FIG. 4.

A fusible link according to an embodiment of the present invention will be described with reference to FIGS. 1 to 3. FIG. 1 is three orthographic views illustrating a fuse unit including a fusible link in the embodiment of the present invention. FIG. 2 is three orthographic views illustrating the fusible link illustrated in FIG. 1.

A fuse unit 1 illustrated in FIG. 1 is the one that is directly mounted on a rod-shaped electrode 22 projecting from a terminal mounting surface 21 of a battery 2*e* and includes a battery terminal 11, and a fusible link 12 which is also illustrated in FIG. 2.

The battery terminal 11 is a terminal formed of conductive metal and having a substantially rectangular shape in planar view. On one end side in the longitudinal direction of the battery terminal 11, an electrode insertion hole 111 into which the rod-shaped electrode 22 of the battery 2 is inserted is provided. On the other end side in the longitudinal direction, a screw 112 to couple the battery terminal 11 and the fusible link 12 together is provided. The battery terminal 11 is connected to the rod-shaped electrode 22 of the battery 2 near the one end, and extends toward the other end toward an outer edge 21*a* of the terminal mounting surface 21.

On the battery terminal 11, a cut 113 that leads to the electrode insertion hole 111 is provided. The electrode insertion hole 111 is configured to reduce the diameter thereof by shrinking the width of the cut 113, and on the battery terminal 11, a fastening screw 114 to shrink the width of the cut 113 is provided. Between a screw head 114*a* of the fastening screw 114 and a terminal body 11*a*, a square washer 115 is placed, and the distal end of the fastening screw 114 is screwed on a nut 116 that is placed to sandwich the terminal body 11*a* with the square washer 115. When the fastening screw 114 is tightened, the distance between the square washer 115 and the nut 116 is shrunk and, as a result, the width of the cut 113 is shrunk, and thereby the electrode insertion hole 111 is reduced in diameter. The battery terminal 11 is mechanically fixed to and electrically connected to the rod-shaped electrode 22 as the fastening screw 114 is tightened in a state that the rod-shaped electrode 22 is inserted into the electrode insertion hole 111, and as the electrode insertion hole 111 is reduced in diameter.

The fusible link 12 is formed with a power supply portion 121, two circuit terminals 122, and fuse elements 123 provided on a connection terminal 13 and housed inside a resin housing. 124 composed of insulating resin material. FIG. 3 is a perspective view illustrating a structure object including the power supply portion, the two circuit terminals, and the fuse elements provided on the connection terminal in the fusible link illustrated in FIGS. 1 and 2.

To the connection terminal 13, the battery terminal 11 is connected. The power supply portion 121 is provided on this connection terminal 13 in an integrated manner. The power supply portion 121, and the connection terminal 13 are formed of conductive metal in an integrated manner in a plate shape and are disposed substantially in parallel with the terminal mounting surface 21. The connection terminal 13 on which the power supply portion 121 is provided is in a roughly T-shaped form in planar view. On the connection terminal 13, provided is an insertion hole 13*a* into which the screw 112 of the battery terminal 11 is inserted. The screw 112 inserted into the insertion hole 13*a* is fastened with a nut 117, and thereby the battery terminal 11 is connected to the connection terminal 13. The power supply portion 121 is provided on the connection terminal 13 so as to surround the above-described insertion hole 13*a* in a C-shape opened on the battery terminal 11 side. The power supply portion 121 is supplied with the electrical power via the battery terminal 11 and the connection terminal 13.

Each of the two circuit terminals 122 is formed of conductive metal in a plate shape and is disposed substantially in parallel with the terminal mounting surface 21, and a non-depicted circuit that operates by the electrical power from the battery 2 is connected to. In the embodiment, two pieces of the circuit terminals 122 are disposed in front leaving a gap with the power supply portion 121 in an extending direction D1 of the battery terminal 11 viewed from the power supply portion 121, and the two are disposed in juxtaposition in an intersecting direction D2 that intersects with the extending direction D1 and is substantially in parallel with the terminal mounting surface 21.

Each circuit terminal 122 is disposed so as to form a plane substantially the same as those of the power supply portion 121 and the connection terminal 13, and is formed in an L-shaped form along the edge of the front side in the extending direction D1 of the connection terminal 13 on which the power supply portion 121 is provided. On a horizontal bar portion along the intersecting direction D2 of the L-shaped form, provided is an insertion hole 122*b* into which a connection screw 122*a* for connecting to the circuit terminal 122 the non-depicted circuit that operates by the electrical power from the battery 2 is inserted. To the circuit terminal 122, a round terminal and the like attached to the distal end of an electrical wire extending from the non-depicted circuit is connected by being inserted to the connection screw 122*a* and fastened with a nut.

The fuse elements 123 formed of conductive metal then connect the power supply portion 121 and each of the two circuit terminals 122 in the following manner. In the embodiment, the fuse elements 123 are provided one per each circuit terminal 122 in a total of two. Each fuse element 123, as illustrated in FIG. 3, includes a power-supply side upstanding portion 123*a*, a circuit-side upstanding portion 123*b*, and a bridge portion 123*c*.

The power-supply side upstanding portion 123*a* corresponds, out of the outer circumferential edge of the connection terminal 13 on which the power supply portion 121 is provided and having a substantially T-shaped form in planar view, to an end edge of the horizontal bar of the letter T near the power supply portion 121, and stands in an out-of-plane direction D3 of the terminal mounting surface 21 from an edge 13*b* that is substantially in parallel with the extending direction D1 of the battery terminal 11. In the embodiment, the power-supply side upstanding portion 123*a* is formed extending in a belt-like form from the edge 13*b* that is substantially in parallel with the extending direction D1 of the connection terminal 13 on which the power supply portion 121 is provided and being bent up in the out-of-plane direction D3.

The circuit-side upstanding portion 123*b* corresponds, out of the outer circumferential edge of the circuit terminal 122 having the L-shaped form in planar view, to a side edge of the vertical bar of the letter L, and stands in the direction the same as that of the power-supply side upstanding portion 123*a* from an edge 122*c* substantially in parallel with the above-described extending direction D1. In the embodiment, the circuit-side upstanding portion 123*b* is formed extending in a belt-like form from the edge 122*c* that is substantially in parallel with the extending direction D1 of the circuit terminal 122 and being bent up in the out-of-plane direction D3.

The bridge portion 123*c* extends between the power-supply side upstanding portion 123*a* and the circuit-side upstanding portion 123*b*.

In the embodiment, the fuse element 123 composed of the power-supply side upstanding portion 123*a*, the circuit-side upstanding portion 123*b*, and the bridge portion 123*c* explained in the foregoing is a fuse that fuses when a current equal to or greater than a threshold value flows. In the embodiment, the two fuse elements 123 are formed, by making the power-supply side upstanding portions 123*a* and the circuit-side upstanding portions 123*b* stand by folding after cutting them out in an unfolded shape from a single plate of conductive metal, together with the connection terminal 13 on which the power supply portion 121 is provided and the two circuit terminals 122.

The fusible link 12 in the embodiment, as illustrated in FIG. 2, is formed with the structure object including the power supply portion 121, the two circuit terminals 122, and the two fuse elements 123 provided on the connection terminal 13, by molding with the insulating resin material. The resin housing 124 composed of the insulating resin material covers and fixes a part of the above-described structure object in a state that the connection surfaces of the connection terminal 13 and each of the circuit terminals 122 are exposed and windows 124*a* are provided such that the fusing of the fuse elements 123 is visible. This resin housing 124 is formed in an integrated manner with the above-described structure object by insert molding. This insert molding is performed in a state that the connection screw 122*a* is being inserted into the insertion hole 122*b* of the circuit terminal 122. On the window 124*a* for viewing of fusing in the resin housing 124, a transparent cover 125 is put on, and the fusing of the fuse element 123 is visible through this transparent cover 125. The transparent cover 125 is a cover having an L-shaped cross-section as illustrated in FIG. 3 to cover the fuse element 123 that stands as described above.

According to the fusible, link 12 in the above-described embodiment, the fuse element 123 is formed of the power-supply side upstanding portion 123*a* that stands in the out-of-plane direction D3 from the edge 13*b* substantially in parallel with the extending direction D1 near the power supply portion 121 of the connection terminal 13, the circuit-side upstanding portion 123*b* that stands in the out-of-plane direction D3 from the edge 122*c* substantially in parallel with the extending direction D1 of the circuit terminal 122, and the bridge portion 123*c* that extends between the power-supply side upstanding portion 123*a* and the circuit-side upstanding portion 123*b*. Thus, when the fuse element 123 is viewed from the out-of-plane direction D3, the projecting lengths in the intersecting direction D2 from the power supply portion 121 and from the circuit terminal 122 can be shortened. Consequently, the fusible link 12 in the embodiment achieves downsizing in the intersecting direction D2.

According to the fusible link 12 in the embodiment, the power-supply side upstanding portion 123*a* is formed being bent up from the edge 13*b* substantially in parallel with the extending direction D1 near the power supply portion 121 of the connection terminal 13, and the circuit-side upstanding portion 123*b* is formed being bent up from the edge 122*c* substantially in parallel with the extending direction D1 of the circuit terminal 122. Consequently, in the embodiment, the connection terminal 13 on which the power supply portion 121 is provided, the circuit terminals 122, and the fuse elements 123 are formed by a simple process of performing folding after cutting them out in an unfolded shape from a single plate of conductive metal, and thus the reduction in cost by the reduction in the number of components and by the simplification of the manufacturing process is achieved.

The two embodiments in the foregoing merely exemplify a typical form of the present invention, and the present invention is not intended to be limited to those embodiments. That is, various modifications can be implemented without departing from the scope of the spirit of the present invention. Naturally, even with such a modification, it is included in the scope of the present invention as long as the configuration of the fusible link of the present invention is included.

For example, in the above-described embodiment, as an example of a power supply portion in the present invention, the power supply portion 121 provided on the connection terminal 13 to which the battery terminal 11 is connected has been exemplified. The power supply portion in the present invention, however, is not limited to these, and it may be the one provided on the battery terminal. In this case, the fuse elements are formed so as, to connect the power supply portion provided on this battery terminal, and the circuit terminals.

In the above-described embodiment, as an example of a fusible link in the present invention, the fusible link 12 in a form that two pieces of the circuit terminals 122 are provided and that a single piece of the fuse element 123 is provided for each of the circuit terminals 122 has been exemplified. The fusible link in the present invention, however, is not limited to this form, and it may be in a form provided with the circuit terminal of a single piece, or three or more pieces. When a plurality of circuit terminals are provided, the fuse elements may not be provided on all of the circuit terminals, and it may be in a form that the fuse elements are provided only on the circuit terminals to which the circuits that need the protection by fusing are connected.

In the above-described embodiment, as one example of a fuse element in the present invention, the fuse element 123 that is provided with the power-supply side upstanding portion 123*a*, the circuit-side upstanding portion 123*b*, and the bridge portion 123*c* and that a whole of the foregoing has the function of fusing has been exemplified. The fuse element in the present invention, however, is not limited to this, and it only needs to be the one in which at least one of the power-supply side upstanding portion, the circuit-side upstanding portion, and the bridge portion functions as a fuse element that fuses when a current equal to or greater than a threshold value flows.

In the above-described embodiment, as examples of a power-supply side upstanding portion, a circuit-side upstanding portion, and a bridge portion in the present invention, the linear power-supply side upstanding portion 123*a*, the linear circuit-side upstanding portion 123*b*, and the linear bridge portion 123*c*, respectively, have been exemplified. However, the power-supply side upstanding portion, the circuit-side upstanding portion, and the bridge portion in the present invention are not limited to such a linear shape, and may be in a meander shape, for example, and a specific shape does not matter.

In the above-described embodiment, as examples of a connection terminal on which the power supply portion is provided and a circuit terminal in the present invention, the connection terminal 13 in a substantially T-shaped form in planar view and the circuit terminal 122 in a substantially L-shaped form, respectively, have been exemplified. However, the connection terminal on which the power supply portion is provided and the circuit terminal in the present invention are not limited to these. The connection terminal on which the power supply portion is provided and the circuit terminal in the present invention may be in a simple quadrangular shape and the like, for example, and their specific shape does not matter, as long as the terminals each include an edge substantially in parallel with the extending direction of the battery terminal, for the power-supply side upstanding portion and the circuit-side upstanding portion to stand.

According to one aspect of the present invention, at least one of the power-supply side upstanding portion standing in the out-of-plane direction from the edge substantially in parallel with the extending direction near the power supply portion of the connection terminal, the circuit-side upstanding portion standing in the out-of-plane direction from the edge substantially in parallel with the extending direction of the circuit terminal, and the bridge portion extending between the power-supply side upstanding portion and the circuit-side upstanding portion functions as a fuse element. Consequently, when the fuse element is viewed from the out-of-plane direction, the projecting lengths, in the intersecting direction that intersects with the extending direction and is substantially in parallel with the terminal mounting surface, from the power supply portion provided on the connection terminal and from the circuit terminal can be shortened, and thus the fusible link can be, downsized in the intersecting direction.

According to another aspect of the present invention, the power-supply side upstanding portion is formed being bent up from the edge substantially in parallel with the extending direction near the power supply portion of the connection terminal, and the circuit-side upstanding portion is formed being bent up from the edge substantially in parallel with the extending direction of the circuit terminal. Consequently, the connection terminal on which the power supply portion is provided, the circuit terminal, and the fuse element can be formed by a simple process of performing folding after cutting them out in an unfolded shape from a single plate of conductive metal, for example, and thus the reduction in cost by the reduction in the number of components and by the simplification of the manufacturing process can be achieved.

Although the present invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fusible link comprising:

a power supply portion configured to be connected to a battery, the power supply portion formed of conductive metal and having substantially a planar shape, the planar shape of the power supply portion extending substantially in a first direction and a second direction, the first direction being perpendicular to the second direction;

a circuit terminal formed of conductive metal in a plate shape and disposed substantially in parallel with the planar shape of the power supply portion, the circuit terminal configured to be connected to a circuit that is operated by electrical power from the battery;

a power-supply side upstanding portion formed of conductive metal and standing in a third direction, the third direction perpendicular to the first direction and the second direction, the power-supply side upstanding portion extending from an edge of the power supply portion in the second direction;

a circuit-side upstanding portion formed of conductive metal and standing in the third direction, the circuit-side upstanding portion extending from an edge of the circuit terminal in the second direction; and a bridge portion formed of conductive metal and extending between the power-supply side upstanding portion and the circuit-side upstanding portion, the bridge portion extending from each of the power-supply side upstanding portion and the circuit-side upstanding portion in the first direction, wherein at least one of the power-supply side upstanding portion, the circuit-side upstanding portion, and the bridge portion functions as a fuse element that fuses when a current equal to or greater than a threshold value flows.

2. The fusible link according to claim 1, wherein the power-supply side upstanding portion is formed extending in a belt-like form, and the circuit-side upstanding portion is formed extending in a belt-like form.

3. The fusible link according to claim 1, wherein the bridge portion functions as the fuse element.

4. The fusible link according to claim 1, wherein the bridge portion is a linear bridge portion.

5. The fusible link according to claim 1, wherein the circuit terminal is disposed so as to form a plane substantially the same as that of the power supply portion.

6. The fusible link according to claim 1, further comprising a transparent cover covering the fuse element, wherein the transparent cover is formed with a top part having a planar shape extending in the first direction and the second direction, and a side part having a planar shape extending in the first direction and the third direction.

* * * * *